US009336915B2

(12) United States Patent
Norling et al.

(10) Patent No.: US 9,336,915 B2
(45) Date of Patent: May 10, 2016

(54) TARGET APPARATUS AND ISOTOPE PRODUCTION SYSTEMS AND METHODS USING THE SAME

(75) Inventors: Jonas Norling, Uppsala (SE); Tomas Eriksson, Uppsala (SE)

(73) Assignee: General Electric Company, Schenectady, NY (US)

( * ) Notice: Subject to any disclaimer, the term of this patent is extended or adjusted under 35 U.S.C. 154(b) by 754 days.

(21) Appl. No.: 13/162,941

(22) Filed: Jun. 17, 2011

(65) Prior Publication Data

US 2012/0321026 A1 Dec. 20, 2012

(51) Int. Cl.

| | |
|---|---|
| ***G21G 1/10*** | (2006.01) |
| ***G21G 1/00*** | (2006.01) |
| ***H05H 6/00*** | (2006.01) |

(52) U.S. Cl.

CPC ..... *G21G 1/0005* (2013.01); *G21G 1/10* (2013.01); *H05H 6/00* (2013.01); *G21G 2001/0015* (2013.01)

(58) Field of Classification Search

USPC ..... 376/168, 195

See application file for complete search history.

(56) References Cited

U.S. PATENT DOCUMENTS

| | | | | |
|---|---|---|---|---|
| 2,990,354 | A * | 6/1961 | Anderson et al. | 376/311 |
| 5,392,319 | A | 2/1995 | Eggers | |
| 5,475,720 | A * | 12/1995 | Oldenhage et al. | 376/258 |
| 6,392,246 | B1 | 5/2002 | Wiberg et al. | |
| 6,417,634 | B1 | 7/2002 | Bergstrom | |
| 6,433,495 | B1 | 8/2002 | Wiberg | |
| 7,122,966 | B2 | 10/2006 | Norling et al. | |
| 7,127,023 | B2 | 10/2006 | Wieland | |
| 7,466,085 | B2 | 12/2008 | Nutt | |
| 7,476,883 | B2 | 1/2009 | Nutt | |
| 7,512,206 | B2 | 3/2009 | Wieland | |
| 7,940,881 | B2 | 5/2011 | Jongen et al. | |
| 8,106,370 | B2 | 1/2012 | Norling et al. | |
| 8,106,570 | B2 | 1/2012 | Norling et al. | |
| 8,153,997 | B2 | 4/2012 | Norling et al. | |
| 8,374,306 | B2 | 2/2013 | Norling et al. | |

(Continued)

FOREIGN PATENT DOCUMENTS

| | | | |
|---|---|---|---|
| CN | 1726563 | A | 1/2006 |
| JP | 2010533964 | A | 10/2010 |
| WO | 03099374 | A2 | 12/2003 |

OTHER PUBLICATIONS

Peeples, "Design and Optimization of Thennosyphon Batch Targets for Production of F-18" UNC Ph. D Thesis, Dec. 6, 2006.*

(Continued)

*Primary Examiner* — Sean P Burke

(74) *Attorney, Agent, or Firm* — Dean D. Small; The Small Patent Law Group, LLC

(57) ABSTRACT

A target apparatus for a radioisotope production system. The target apparatus includes a production chamber that is configured to contain a starting liquid. The production chamber is configured to receive a particle beam that is incident upon the starting liquid thereby generating radioisotopes and transforming a portion of the starting liquid into vapor. The target apparatus also includes a condensing chamber and a fluid channel that fluidly couples the production and condensing chambers and is configured to allow the vapor to flow from the production chamber to the condensing chamber. The condensing chamber is configured to transform the vapor into a condensed liquid.

19 Claims, 6 Drawing Sheets

(56) References Cited

U.S. PATENT DOCUMENTS

| | | | | |
|---|---|---|---|---|
| 2005/0279130 | A1 | 12/2005 | Bjork | |
| 2005/0283199 | A1 | 12/2005 | Norling et al. | |
| 2007/0036259 | A1* | 2/2007 | Wieland | 376/195 |
| 2009/0052628 | A1 | 2/2009 | Wilson et al. | |
| 2010/0140510 | A1 | 6/2010 | Buescher et al. | |
| 2010/0278293 | A1 | 11/2010 | Stokely et al. | |
| 2010/0294655 | A1 | 11/2010 | Hong et al. | |
| 2012/0069946 | A1 | 3/2012 | Hamill et al. | |
| 2014/0039074 | A1 | 2/2014 | Chi et al. | |

OTHER PUBLICATIONS

Search Report and Written Opinion from corresponding PCT Application No. PCT/US2012/042179 dated Oct. 25, 2012.

Roberts, A. N., "Thermosyphon Targets Designed for the Production of 18F for Use in Positron Emission Tomography", pp. 1-69, 2002.

Stokely, M. H., "Advanced Thermosyphon Targets for Production of the18F Radionuclide", pp. 1-45, 2007.

Doster, J. M., "New Cyclotron Targetry to Enhance F-18 Clinical Position Emission Tomography", pp. 1-52, Dec. 19, 2008.

Radiopharmaceuticals: Production and Availability, 2007, pp. 1-10, International Atomic Energy Agency.

Nye, et al. "Pushing the Limits of an O-18 Water Target", 2003, pp. 1098-1101, Application of Accelerators in Research and Industry: 17th Int'l Conference, American Institute of Physics.

Hong et al. "The Performance of Double-Grid O-18 Water Target for FDG Production", pp. 2337-2339, 2006, Proceedings of EPAC, Edinburgh, Scotland.

Finn et al. "Production Considerations for the "Classical" Pet Nuclides", 2001, pp. 1-38, Brookhaven National Laboratory.

"Cyclotron Produced Radionuclides Guidance on Facility Design and Production of FDG", 2012, cover page and pp. 62-65, International Atomic Energy Agency.

"Advantages of Boiling Water Reactors (BWR) Fact Sheet", 2 pages, 2010, GE Hitachi Nuclear Energy.

Unofficial English translation of Chinese Office Action and Search Report issued in connection with corresponding CN Application No. 201280029863.0 on Jun. 15, 2015.

Chinese Office Action for Application No. 2012800298630 dated Jan. 29, 2016. English translation included. 18 pages.

* cited by examiner

TARGET APPARATUS AND ISOTOPE PRODUCTION SYSTEMS AND METHODS USING THE SAME

BACKGROUND OF THE INVENTION

The subject matter disclosed herein relates generally to isotope production systems, and more particularly to target apparatus of isotope production systems that are configured to control thermal energy within a target chamber.

Radioisotopes (also called radionuclides) have several applications in medical therapy, imaging, and research, as well as other applications that are not medically related. Systems that produce radioisotopes typically include a particle accelerator that generates a particle beam. The particle accelerator directs the beam toward a target material in a target chamber. In some cases, the target material is a liquid (also referred to as a starting liquid), such as enriched water. Radioisotopes are generated through a nuclear reaction when the particle beam is incident upon the starting liquid in the target chamber.

However, the incident particle beam can also significantly increase the thermal energy of the starting liquid thereby transforming at least a portion of the starting liquid into a vapor. The vapor increases the pressure within the target chamber. To limit transformation of the liquid into vapor, conventional systems may reduce the beam current to a predetermined level and/or inject a working gas (e.g., helium) into the target chamber that effectively raises the boiling temperature of the starting liquid. However, reducing the beam current may also reduce production of radioisotopes.

BRIEF DESCRIPTION OF THE INVENTION

In accordance with one embodiment, a target apparatus for a radioisotope production system is provided. The target apparatus includes a production chamber that is configured to contain a starting liquid. The production chamber is configured to receive a particle beam that is incident upon the starting liquid thereby generating radioisotopes and transforming a portion of the starting liquid into vapor. The target apparatus also includes a condensing chamber and a fluid channel that fluidly couples the production and condensing chambers and is configured to allow the vapor to flow from the production chamber to the condensing chamber. The condensing chamber is configured to transform the vapor into a condensed liquid.

The condensing chamber and the fluid channel may be sized and shaped relative to each other so that the vapor entering the condensing chamber expands thereby reducing a pressure of the vapor and facilitating transformation of the vapor into the condensed liquid. Alternatively or in addition to the above, an interior surface of the condensing chamber may have a surface temperature that is less than a surface temperature of an interior surface of the fluid channel thereby facilitating transformation of the vapor into the condensed liquid.

In accordance with another embodiment, an isotope production system is provided that includes a particle accelerator that is configured to produce a particle beam and a target apparatus that has a window configured to receive a particle beam. The target apparatus also includes separate production and condensing chambers. The production chamber is configured to contain a starting liquid and is located so that the particle beam is incident upon the starting liquid thereby generating radioisotopes and transforming a portion of the starting liquid into vapor. The target apparatus also includes a fluid channel that extends between and fluidly coupling the production and condensing chambers and is configured to flow from the production chamber through the fluid channel and into the condensing chamber. The condensing chamber is configured to transform the vapor in the condensing chamber into a condensed liquid.

In accordance with yet another embodiment, a method of controlling thermal energy in a target apparatus during operation of an isotope production system is provided. The method includes providing a target apparatus having production and condensing chambers and a fluid channel that fluidly couples the production and condensing chambers. The method also includes directing a particle beam onto the starting liquid thereby transforming a portion of the starting liquid into vapor. The vapor flows through the fluid channel into the condensing chamber and is transformed into a condensed liquid. The condensing chamber has a liquid volume of the condensed liquid and the production chamber has a liquid volume of the starting liquid. The liquid volumes of the production and condensing chambers are inversely related and fluctuate as the condensed liquid returns to the production chamber through the fluid channel and as the vapor enters the condensing chamber through the fluid channel.

DETAILED DESCRIPTION OF THE INVENTION

Figure 1:
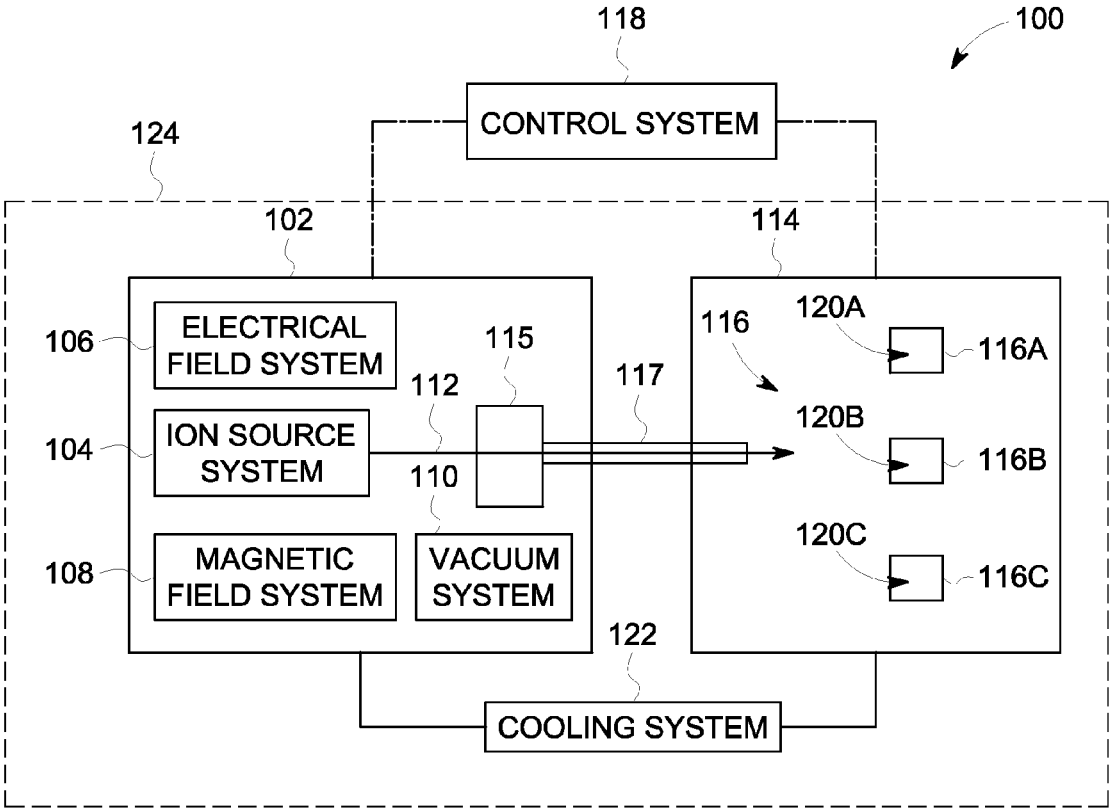
FIG. 1 is a block diagram of an isotope production system having a target apparatus formed in accordance with one embodiment.

The foregoing summary, as well as the following detailed description of certain embodiments will be better understood when read in conjunction with the appended drawings. To the extent that the figures illustrate diagrams of the blocks of various embodiments, the blocks are not necessarily indicative of the division between hardware or structures. Thus, for example, one or more of the blocks may be implemented in a single piece of hardware or multiple pieces of hardware. It should be understood that the various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated, such as by stating "only a single" element or step. Furthermore, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

Also, as used herein, the term "fluid" generally means any flowable medium such as liquid, gas, vapor, supercritical fluid, or combinations thereof. The term "liquid" can include a liquid medium in which a gas is dissolved and/or a bubble is present. As used herein, the term "vapor" generally means any fluid that can move and expand without restriction except for a physical boundary such as a surface or wall, and thus can include a gas phase, a gas phase in combination with a liquid phase such as a droplet (e.g., steam), supercritical fluid, or the like.

Various embodiments provide a target apparatus for isotope production systems that uses a heat transfer mechanism for removing heat from a target or production chamber. The mechanism may allow heated vapor to move from a first chamber into a second chamber, condense the vapor in the second chamber into a liquid, and then allow the condensed liquid to move back into the first chamber where the condensed liquid mixes with the starting liquid. The volumes of the condensed liquid and starting liquid may fluctuate within the respective chambers during production of the radioisotopes. In some embodiments, the heat transfer mechanism is an active cooling system that actively transfers thermal energy away from the second chamber through, for example, a cooling passage(s) that flows a working fluid proximate to the second chamber. Thus, a target apparatus and a method for removing thermal energy from a production chamber are provided that may allow a higher beam current.

Alternatively or in addition to the heat transfer mechanism, the first and second chambers may be fluidly coupled through a fluid channel. The fluid channel and the second chamber may be sized and shaped relative to each other so that the vapor expands when entering the second chamber. The expansion of the vapor may facilitate transforming the vapor into a condensed liquid.

A target apparatus formed in accordance with various embodiments may be used in different types and configurations of isotope production systems. For example, FIG. 1 is a block diagram of an isotope production system 100 that includes a particle accelerator 102 (e.g., isochronous cyclotron) having several sub-systems including an ion source system 104, an electrical field system 106, a magnetic field system 108, and a vacuum system 110. When the particle accelerator 102 is a type of cyclotron, charged particles may be placed within or injected into the particle accelerator 102 through the ion source system 104. The magnetic field system 108 and electrical field system 106 generate respective fields that cooperate with one another in producing a particle beam 112 of the charged particles. Although in one embodiment the particle accelerator 102 may be a cyclotron, other embodiments may use different types of particle accelerators to provide particle beams.

Also shown in FIG. 1, the system 100 has an extraction system 115 and a target system 114 that includes one or more target apparatus 116 having respective target materials (not shown). The target system 114 may be positioned immediately adjacent to or spaced apart from the particle accelerator 102. The target apparatus 116 may be, for example, the target apparatus 200 described in greater detail below. To generate radioisotopes, the particle beam 112 is directed by the particle accelerator 102 through the extraction system 115 along a beam transport path or beam passage 117 and into the target system 114 so that the particle beam 112 is incident upon the target material located at a corresponding target or production chamber 120 within the corresponding target apparatus 116. When the target material is irradiated with the particle beam 112, the target material may generate radioisotopes through nuclear reactions. Thermal energy may also be generated within the production chamber 120.

As shown, the system 100 may have multiple target apparatus 116A-C with respective production chambers 120A-C where target materials are located. A shifting device or system (not shown) may be used to shift the production chambers 120A-C with respect to the particle beam 112 so that the particle beam 112 is incident upon a different target material for different production sessions. Alternatively, the particle accelerator 102 and the extraction system 115 may not direct the particle beam 112 along only one path, but may direct the particle beam 112 along a unique path for each different production chamber 120A-C. Furthermore, the beam passage 117 may be substantially linear from the particle accelerator 102 to the production chamber 120 or, alternatively, the beam passage 117 may curve or turn at one or more points therealong. For example, magnets (not shown) positioned alongside the beam passage 117 may be configured to redirect the particle beam 112 along a different path.

Examples of isotope production systems and/or cyclotrons having one or more of the sub-systems are described in U.S. Pat. Nos. 6,392,246; 6,417,634; 6,433,495; and 7,122,966 and in U.S. Patent Application Publication No. 2005/0283199. Additional examples are also provided in U.S. Pat. Nos. 5,521,469; 6,057,655; 7,466,085; and 7,476,883. Furthermore, isotope production systems and/or cyclotrons that may be used with embodiments described herein are also described in copending U.S. patent application Ser. Nos. 12/492,200; 12/435,903; 12/435,949; and 12/435,931. The target apparatus and methods described herein may be used with these exemplary isotope production systems and/or cyclotrons as well as others.

The system 100 is configured to produce radioisotopes (also called radionuclides) that may be used in medical imaging, research, and therapy, but also for other applications that are not medically related, such as scientific research or analysis. When used for medical purposes, such as in Nuclear Medicine (NM) imaging or Positron Emission Tomography (PET) imaging applications, the radioisotopes may also be called tracers. By way of example, the system 100 may generate protons to make isotopes in liquid form, such as $^{18}F^-$ isotopes. $^{13}N$ isotopes may also be generated by the system 100. The target material used to make these isotopes may be enriched $^{18}O$ water or $^{16}O$-water.

In some embodiments, the system 100 uses $^1H^-$ technology and brings the charged particles to a low energy (e.g., about 9.6 MeV) with a beam current of approximately 10-1000 μA or, more particularly, approximately 10-500 μA. In particular embodiments, the system 100 uses $^1H^-$ technology and brings the charged particles to a low energy (e.g., about 9.6 MeV) with a beam current of approximately 10-200 μA or, more particularly, approximately 10-70 μA. In such embodiments, the negative hydrogen ions are accelerated and guided through the particle accelerator 102 and into the extraction system 115. The negative hydrogen ions may then hit a stripping foil (not shown in FIG. 1) of the extraction system 115 thereby removing the pair of electrons and making the particle a positive ion, $^1H^+$. However, embodiments described herein may be applicable to other types of particle accelerators and cyclotrons. For example, in alternative embodiments, the charged particles may be positive ions, such as $^1H^+$, $^2H^+$, and $^3He^+$. In such alternative embodiments, the extraction system 115 may include an electrostatic deflector that creates an electric field that guides the particle beam toward the production chamber 120. Furthermore, in other embodiments, the beam current may be, for example, up to approximately 200 μA. The beam current could also be up to approximately 2000 μA or more.

The system 100 may also be configured to accelerate the charged particles to a predetermined energy level. For example, some embodiments described herein accelerate the charged particles to an energy of approximately 18 MeV or less. In other embodiments, the system 100 accelerates the charged particles to an energy of approximately 16.5 MeV or less. However, embodiments describe herein may also have an energy above 16.5 MeV. For example, embodiments may have an energy above 100 MeV, 500 MeV or more.

The system 100 may produce the isotopes in approximate amounts or batches, such as individual doses for use in medical imaging or therapy. Accordingly, isotopes having different levels of activity may be provided.

The system 100 may include a cooling system 122 that transports a cooling or working fluid to various components of the different systems in order to absorb heat generated by the respective components. The system 100 may also include a control system 118 that may be used by a technician to control the operation of the various systems and components. The control system 118 may include one or more user-interfaces that are located proximate to or remotely from the particle accelerator 102 and the target system 114. Although not shown in FIG. 1, the system 100 may also include one or more radiation and/or magnetic shields for the particle accelerator 102 and the target system 114.

Figure 2:
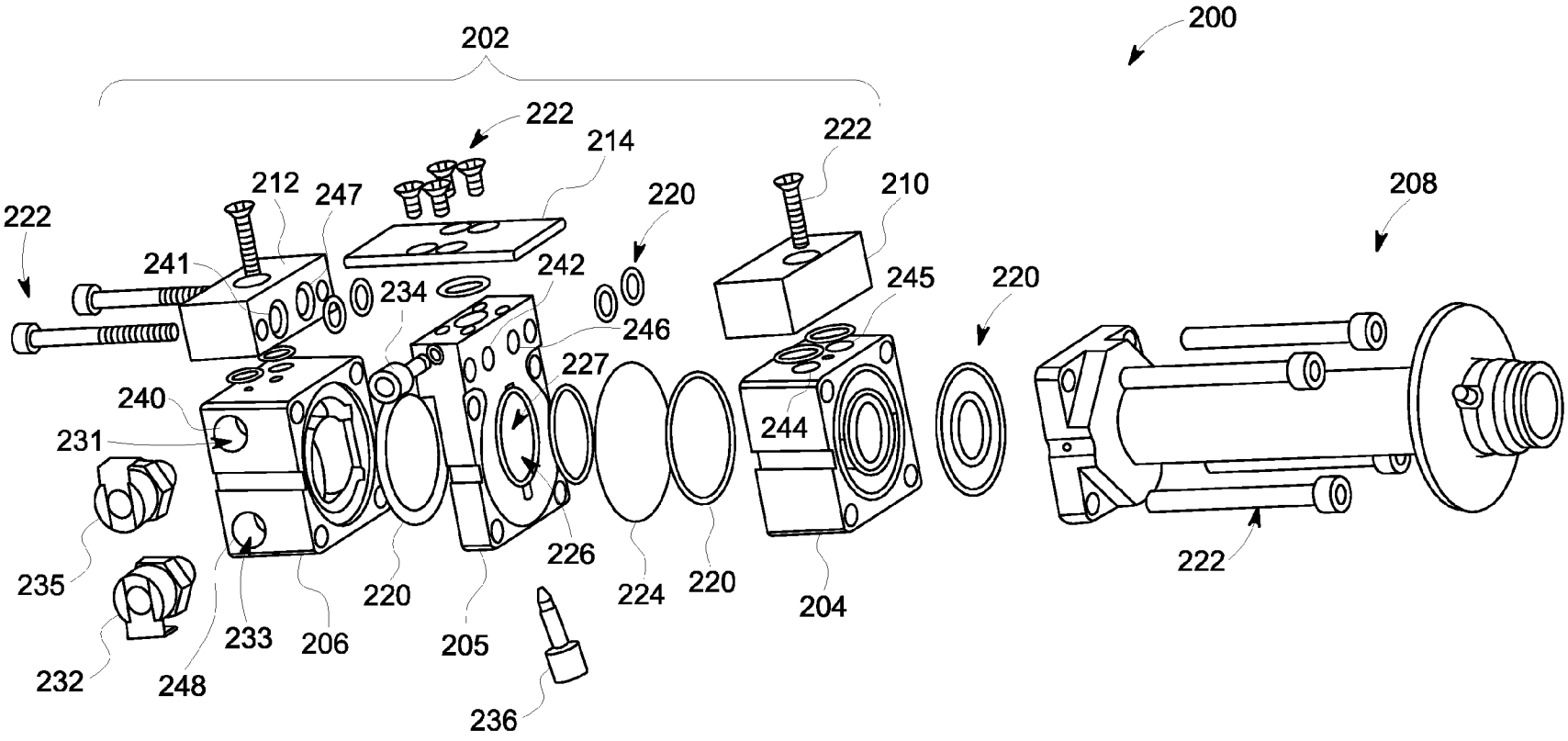
FIG. 2 is an exploded view of a target apparatus formed in accordance with one embodiment.

An exemplary target apparatus 200 is illustrated in FIGS. 2-5. FIG. 2 is an exploded perspective view of the target apparatus 200 illustrating various components that may be assembled together to form the target apparatus 200. However, the components shown and described herein are only exemplary and the target apparatus may be constructed according to other configurations. For example, some of the components may be combined into a single structure in other embodiments. As shown, the target apparatus 200 includes a beam conduit 208 and a target housing 202 that is configured to be coupled to the beam conduit 208. The beam conduit 208 may enclose a beam passage, such as the beam passage 117 (FIG. 1). As shown, the target housing 202 may include a plurality of housing portions 204-206. The housing portion 204 may be referred to as a leading housing portion that couples to the beam conduit 208, the housing portion 205 may be referred to as a target body, and the housing portion 206 may be referred to as a trailing housing portion. Although not shown, the target apparatus 200 may fluidly couple to a fluidic system that delivers and removes a working fluid(s) for cooling and controlling production of the radioisotopes and also to a fluidic system that delivers and removes the liquid that carries the radioisotopes.

The target apparatus 200 can also include mounting members 210 and 212 and a cover plate 214. The housing portions 204-206, the mounting members 210, 212, and the cover plate 214 may comprise a common material or be fabricated from different materials. For example, the housing portions 204-206, the mounting members 210, 212, and the cover plate 214 may comprise metal or metal alloys that include aluminum, steel, tungsten, nickel, copper, iron, niobium, or the like. In some embodiments, the materials of the various components may be selected based upon the thermal conductivity of the material and/or the ability of the materials to shield radiation. The components may be molded, die-cast, and/or machined to include the operative features disclosed herein such as the various openings, recesses, passages, or cavities shown in FIG. 2.

For example, the housing portions 204-206 and the mounting members 210, 212 may include passages 240-248 that extend through the respective components. (Passages extending through the mounting member 210 are not shown.) The target body 205 has a cavity 226 that may extend entirely through a thickness of the target body 205. In other embodiments, the cavity 226 extends only a limited depth into the target body 205. The cavity 226 has a window 227 that provides access to the cavity 226. The target apparatus 200 may also include nozzles or valves 235, 232 that are configured to be inserted into respective openings 231, 233 of the housing portion 206. Nozzles or valves 234, 236 may also be inserted into respective openings of the target body 205.

The target apparatus 200 can also include a variety of sealing members 220 and fasteners 222. The sealing members 220 are configured to seal interfaces between the components to maintain a predetermined pressure within the target apparatus 200 (e.g., such as the fluid circuit formed by the passages 240-248), to prevent contamination from the ambient environment, and/or to prevent fluid from escaping into the ambient environment. The fasteners 222 secure the components to each other. Also shown, the target apparatus 200 may include at least one foil member 224. The particle beam is configured to be incident upon the foil member 224.

Figure 3:
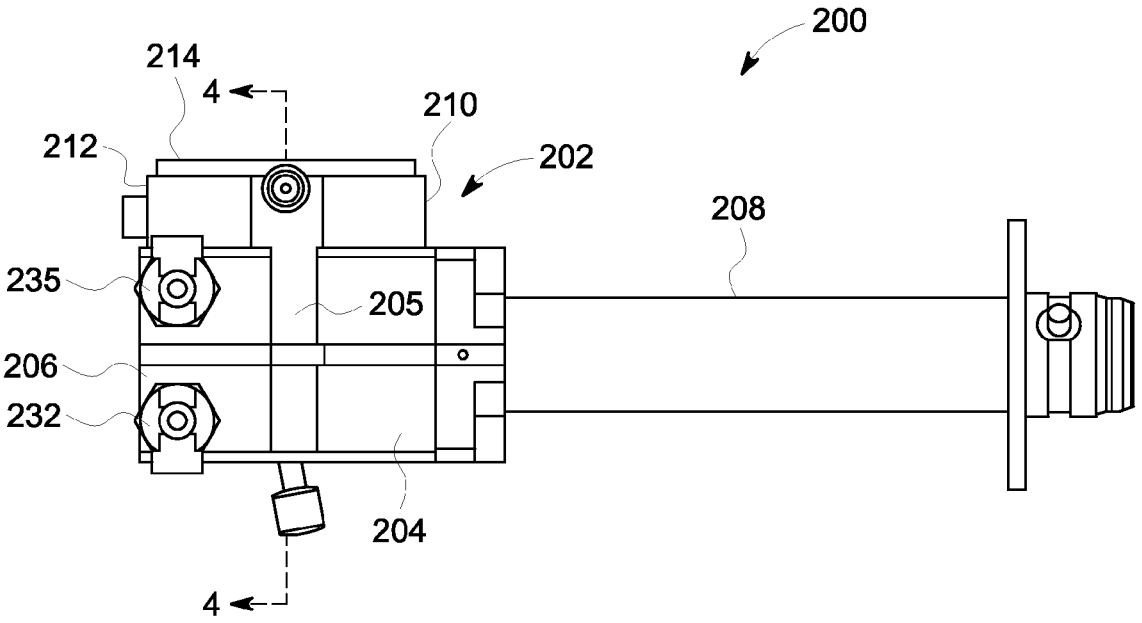
FIG. 3 is a side view of the target apparatus of FIG. 2.
Figure 4:
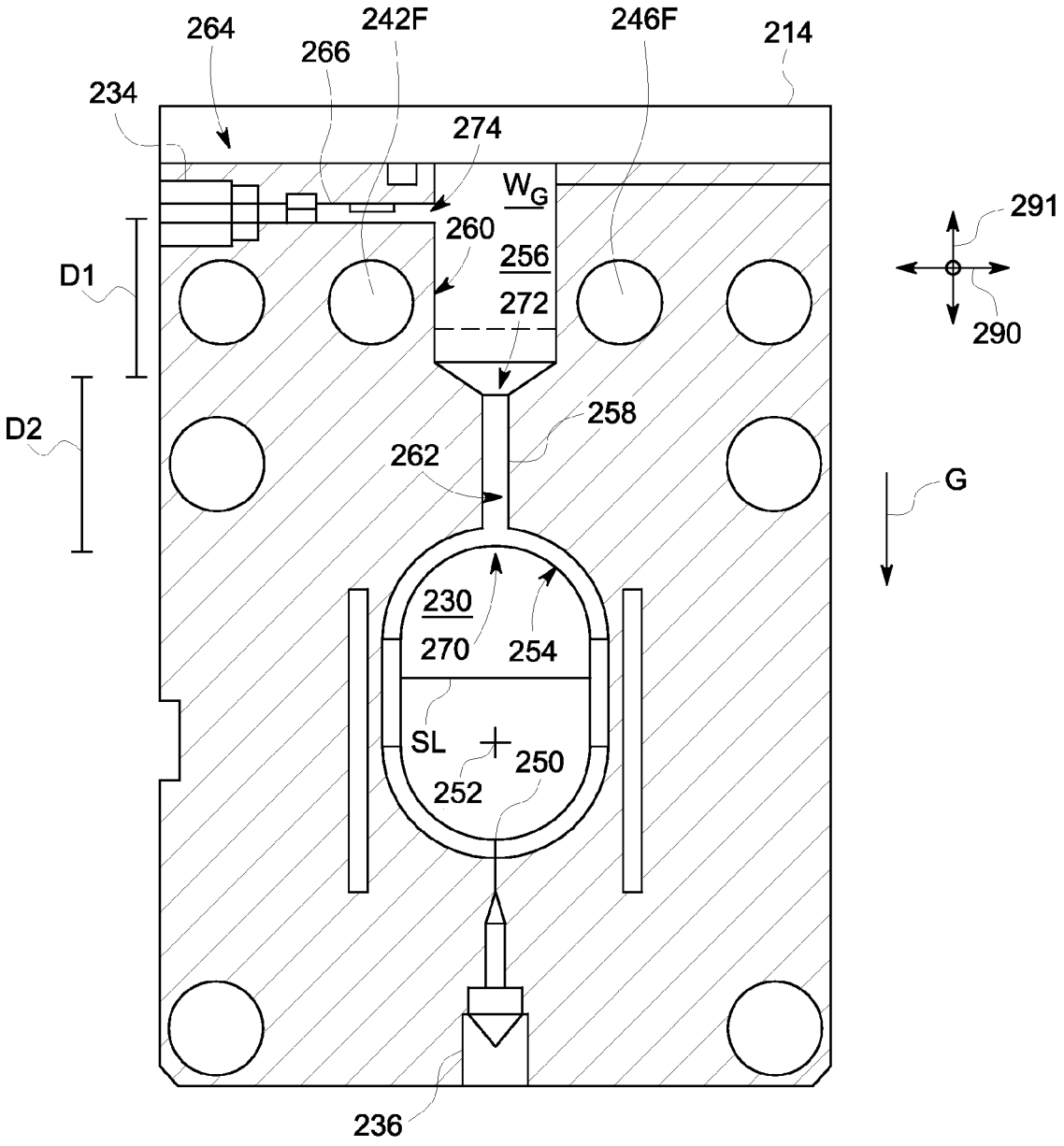
FIG. 4 is a cross-section of the target apparatus taken along the lines 5-5 in FIG. 4.

As shown in FIG. 3, when the target apparatus 200 is fully constructed, the target body 205 is sandwiched between the housing portions 204, 206 so that the target cavity 226 (FIG. 2) is enclosed to form a production chamber 230 (FIG. 4). The beam conduit 208 is secured to the housing portion 204. The beam conduit 208 is configured to receive the particle beam and permit the particle beam to be incident upon the production chamber 230. Also, when the target housing 202 is constructed, the passages 240-248 (FIG. 2) may form a fluid circuit that directs a working fluid (e.g., cooling fluid such as water) through the target housing 202 to absorb thermal energy and transfer the thermal energy away from the target housing 202. Incoming fluid may enter through the nozzle 235 and exit through the nozzle 232. In other embodiments, the incoming fluid may enter through the nozzle 232 and exit through the nozzle 234.

FIG. 4 is a cross-section of the target body 205 taken along the lines 4-4 in FIG. 3. As described above, the production chamber 230 is formed within the target housing 202 (FIG. 2) when the target body 205 is stacked with respect to the housing portions 204 and 206. However, in alternative embodiments, the production chamber 230 may be formed by other methods. The production chamber 230 is disposed within the target housing 202 and is defined by an interior surface 254. In an exemplary embodiment, the interior surface 254 includes multiple separate surfaces that are combined together to form the interior surface 254. The production chamber 230 is configured to contain or hold a starting liquid SL. The starting liquid SL may be injected into the production chamber 230 through the nozzle 236 that has access to the production chamber 230 through the interior surface 254 at a port 250. The production chamber 230 is located so that the particle beam may be incident upon the starting liquid SL at a strike point 252.

Also shown, the target housing 202 includes a condensing chamber 256 and a fluid channel 258 that are also disposed within the target housing 202. The fluid channel 258 fluidly couples the production chamber 230 and the condensing chamber 256. The condensing chamber 256 is defined by an interior surface 260, and the fluid channel 258 is defined by an interior surface 262. As described above with respect to the interior surface 254, each of the interior surfaces 260 and 262 may be defined by multiple surfaces. However, in the illustrated embodiment, each of the interior surfaces 260 and 262 is one continuous surface that is molded or machined into the target body 205.

In the illustrated embodiment, the target body 205 includes a single continuous structure that at least partially defines each of the production chamber 230, the fluid channel 258, and the condensing chamber 256. In other words, the same piece of material may at least partially define each of the production chamber 230, the fluid channel 258, and the condensing chamber 256. However, in other embodiments, the target body 205 may include multiple separate body structures that form the target body. For example, a first body structure can include the production chamber 230 and a separate second body structure can include the condensing chamber 256. Either of the first and second body structures may include at least a portion of the fluid channel 258. The first and second body structures can also be spaced apart from each other. In such embodiments where the first and second body structures are spaced apart, the fluid channel 258 may be defined by a third body structure, such as flexible tubing or a pipe.

When the target apparatus 200 is in operation, the target apparatus 200 has a total production volume $V_{TP}$ that includes a chamber volume $V_{C1}$ of the production chamber 230, a channel volume $V_{C2}$ of the fluid channel 258, and a chamber volume $V_{C3}$ of the condensing chamber 256. The condensing chamber 256 and the production chamber 230 are in fluid communication through the fluid channel 258. In the illustrated embodiment, the condensing chamber 256 and the production chamber 230 are in direct fluid communication through the fluid channel 258 such that no other chambers exist between the production and condensing chambers 230, 256.

The target apparatus 200 may also include a gas line 264 that includes a gas channel 266 and the nozzle 234. The nozzle 234 may constitute or be part of a pressure regulator that regulates the flow of a working gas $W_G$ into and out of the condensing chamber 256. The gas line 264 also includes other components that are not shown, such as additional gas channels and a gas source. The gas line 264 is configured to provide the working gas $W_G$ into the total production volume $V_{TP}$ and, more particularly, directly into the condensing chamber 256. The working gas $W_G$ may be configured to raise the boiling temperature of the starting liquid SL. As a non-limiting example, the working gas $W_G$ may include helium.

The target apparatus 200 may be oriented with respect to axes 290 and 291. In some embodiments, the axis 291 may also be referred to as a gravitational force axis since the axis 291 is aligned with gravity. As indicated by the arrow G, gravity can facilitate pulling liquid within the total volume $V_{TP}$ in one general direction. Also, gas or vapor within the total volume $V_{TP}$ may generally rise above the liquid in a direction that is opposite that of the arrow G.

As shown, the fluid channel 258 and the condensing chamber 256 are fluidly coupled through the port 272, and the fluid channel 258 and the production chamber 230 are fluidly coupled through the port 270. As such, the fluid channel 258 fluidly couples the production chamber 230 and the condensing chamber 256 through ports 270, 272. The gas line 264 has fluidic access to the condensing chamber 256 through a port 274. The port 274 is located a separation distance $D_1$ away from the port 272 measured along the axis 291. As will be described in greater detail below, a value of the separation distance $D_1$ may be configured to prevent the formation or deposition of liquid within the gas line 264 and, in particular, the gas channel 266.

During operation of the target apparatus 200, the interior surfaces 254, 260, 262 may have respective surface temperatures. In an exemplary embodiment, the target apparatus 200 is configured to remove thermal energy away from the interior surface 260 to facilitate transformation of the vapor into liquid. For example, the interior surfaces 262 and 254 may have approximately equal surface temperatures or the surface temperature of the interior surface 262 may be slightly less than the surface temperature of the interior surface 254. However, the surface temperature of the interior surface 260 may be less than the surface temperatures of the interior surfaces 254, 262 so that the vapor may be transformed into liquid.

The target body 205 comprises a body material that is thermally conductive. In other words, the body material is configured to absorb thermal energy generated within the production chamber 230 and permit the thermal energy to transfer away from the production chamber 230. The body material may extend between the production and condensing chambers 230, 256. As shown in the illustrated embodiment, the body material can extend continuously between the production and condensing chambers 230, 256.

In particular embodiments, the target housing 202 may also use a cooling mechanism to reduce an amount of thermal energy that is transferred to the interior surface 260 of the condensing chamber 256. For example, the passages 242 and 246 are located adjacent to the condensing chamber 256 and extend in a perpendicular manner with respect to the axes 290 and 291. A working fluid F (e.g., gas or liquid, such as water) is configured to flow through the passages 242 and 246. The working fluid F may absorb thermal energy and transfer the thermal energy away from the target body 205 thereby reducing the heat experienced by the interior surface 260. In other embodiments, a heat sink having fins may be located adjacent to the condensing chamber or within the passages 242, 246 and a working fluid may flow through the fins to remove thermal energy. Accordingly, some embodiments may include an active cooling mechanism that actively cools the condensing chamber 256.

In other embodiments, the target apparatus 200 may utilize other cooling mechanisms. For example, the body material that surrounds and defines the condensing chamber 256 may be different than the body material that surrounds the production chamber 230 and the fluid channel 258. For example, the body material that surrounds the condensing chamber 256 may be relatively insulative compared to the body material that surrounds the production chamber 230. As such, thermal energy transfer to the interior surface 260 is limited by the insulative material.

In an exemplary embodiment, the fluid channel 258, the production chamber 230, and the condensing chamber 256 are disposed within the target housing 202. The fluid channel 258, the production chamber 230, and the condensing chamber 256 may have a fixed relationship with respect to each other. A common structure may at least partially define the fluid channel 258, the production chamber 230, and the condensing chamber 256. As shown, the target body 205 defines at least a portion of each of the fluid channel 258, the production chamber 230, and the condensing chamber 256. The fluid channel 258 may constitute a channel that extends entirely through the body material of the target body 205 such that the fluid channel 258 does not include any flexible conduits, e.g., tubing.

The fluid channel 258 may extend a length or distance $D_2$. The distance $D_2$ may be relatively short so that the production and condensing chambers 230, 256 are proximate to each other. In this manner, fluctuations of pressure and liquid volumes in the production and condensing chambers 230, 256 may be reduced. For example, the distance $D_2$ may be less than about 100 millimeters, less than about 50 millimeters, or less than about 25 millimeters. In particular embodiments, the distance $D_2$ may be less than about 15 millimeters. In more particular embodiments, the distance $D_2$ may be less than about 7 millimeters.

Although the fluid channel 258 is illustrated as being defined by the body material of the target body 205. In other embodiments, the fluid channel 258 may be defined by, for example, flexible tubing that fluidly couples separate body structures. For example, the target body 205 may have a first body structure that includes the production chamber 230 and a separate second body structure that includes the condensing chamber 256. Such first and second structures may be spaced apart from each other by a separation distance and fluidly coupled by the fluid channel that may be defined by, for example, tubing. The separation distance may be several centimeters or more. The separation distance may also have similar values as the distance $D_2$ described above.

Figure 5:
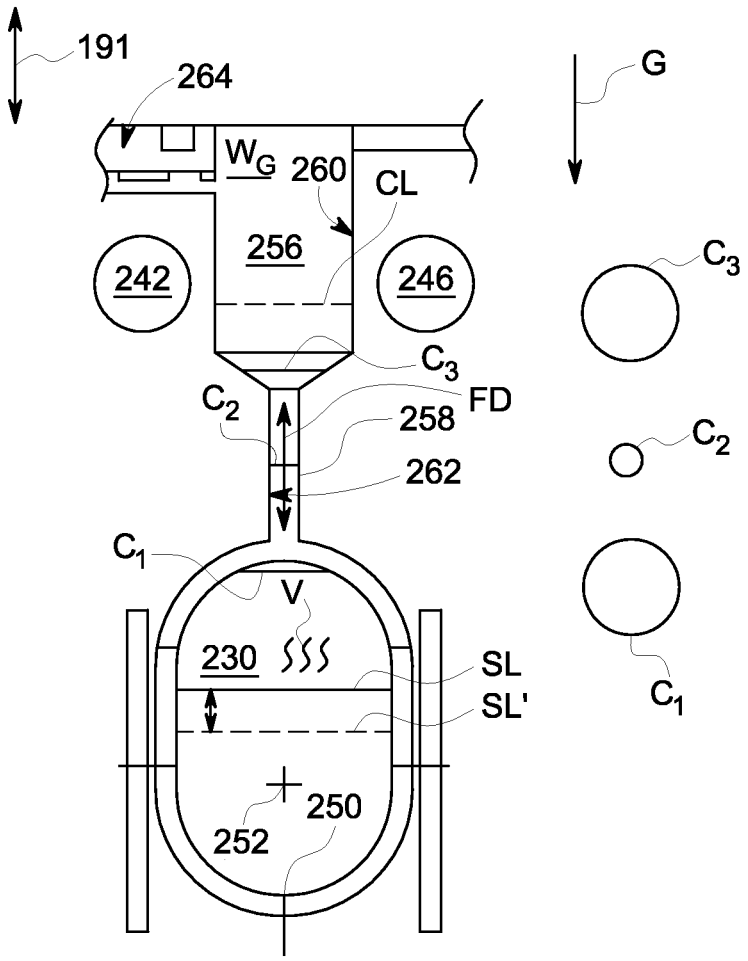
FIG. 5 is an enlarged view of the cross-section shown in FIG. 4.

FIG. 5 includes an enlarged view of the cross-section of FIG. 4. In the illustrated embodiment, fluid (e.g., vapor, liquid) is configured to flow back and forth through the fluid channel 258 along the axis 291. The flow directions are indicated by the double-headed arrow FD. FIG. 5 also illustrates cross-sections $C_1$, $C_2$, $C_3$ that are taken perpendicular to the flow direction FD. More specifically, the cross-section $C_1$ represents a cross-sectional area of the production chamber 230 taken perpendicular to the flow direction FD and proximate to the fluid channel 258; the cross-section $C_2$ represents a cross-sectional area of the fluid channel 258 taken perpendicular to the flow direction FD; and the cross-section $C_3$ represents a cross-sectional area of the condensing chamber 256 taken perpendicular to the flow direction FD and proximate to the fluid channel 258. In an exemplary embodiment, the cross-sectional areas $C_1$ and $C_3$ are greater than the cross-sectional area $C_2$.

During operation of the target apparatus 200, the particle beam is incident upon the starting liquid SL at the strike point 252. The particle beam may be constantly or intermittently applied to the starting liquid SL during a production session. When the particle beam is incident upon the starting liquid SL, radioisotopes are generated within the starting liquid SL. Thermal energy (heat) is also deposited within the starting liquid SL. The increased amount of heat causes at least a portion of the starting liquid SL to transform into vapor V (indicated by wavy lines).

Embodiments described herein utilize thermodynamic principles to cool (e.g., remove thermal energy from) the starting liquid SL. More specifically, as the vapor V is generated within the production chamber 230, the pressure within the production chamber 230 increases. As such, the vapor V is forced through the fluid channel 258 into the condensing chamber 256. Without being limited to a particular theory, at least one of the two following principles may cause the vapor V to transform into a condensed liquid CL. First, as the vapor V flows from the confined space of the fluid channel 258 to the more expansive condensing chamber 256, the vapor V is permitted to expand thereby condensing the liquid. More specifically, as the cross-sectional area of $C_2$ expands to the cross-sectional area of $C_3$, the vapor V is permitted to expand thereby decreasing the pressure experienced by the vapor V. The decrease in pressure may facilitate transforming the vapor V into the condensed liquid CL.

Second, the interior surface 262 of the fluid channel 258 may be at a first surface temperature and the interior surface 260 of the condensing chamber 256 may be at a second surface temperature. In an exemplary embodiment, the first surface temperature is greater than the second temperature. For example, the passages 242, 246 may effectively remove thermal energy that is transferred toward the condensing chamber 256 so that the second temperature is substantially less than the first temperature. As such, thermal energy held by the vapor V may be more quickly transferred from the vapor V to the interior surface 260 thereby transforming the vapor V in the condensing chamber 256 into the condensed liquid CL. The condensed liquid CL may then flow back into the production chamber 230 through the fluid channel 258. When the condensed liquid CL enters the production chamber 230, the condensed liquid CL may mix with the starting liquid SL effectively cooling the starting liquid SL. The condensed liquid CL may also cool the vapor V as the condensed liquid CL flows from the condensing chamber 256 to the production chamber 230.

Accordingly, embodiments may transform the vapor V in at least one of two manners. The condensing chamber 256 and the fluid channel 258 may be sized and shaped relative to each other so that the vapor V entering the condensing chamber 256 expands thereby reducing the pressure of the vapor V and facilitating transformation of the vapor V into the condensed liquid CL. Alternatively or in addition to the change in pressure, the interior surface 260 of the condensing chamber 256 may have a surface temperature that is less than a surface temperature of an interior surface 262 of the fluid channel 258 thereby facilitating transformation of the vapor V into the condensed liquid CL.

In an exemplary embodiment, the production chamber 230, the condensing chamber 256, and the fluid channel 258 are positioned relative to each other to facilitate the flow of the vapor V from the production chamber 230, through the fluid channel 258, and into the condensing chamber 256. Likewise, the production chamber 230, the condensing chamber 256, and the fluid channel 258 may be positioned relative to each other to facilitate the flow of the condensed liquid CL from the condensing chamber 256, through the fluid channel 258, and into the production chamber 230. For example, the production chamber 230, the condensing chamber 256, and the fluid channel 258 may have a predetermined orientation with respect to a gravitational force direction G.

The gas line 264 may control the flow of the working gas $W_G$ into the condensing chamber 256. For example, the gas line 264 may be closed when the particle beam is applied so that the working gas $W_G$ does not flow in and out of the gas channel 266 during operation. Alternatively, the gas line 264 may more actively regulate the pressure in the condensing chamber 256 by adding or removing the working gas $W_G$ during operation. Upon completion of the production session, the liquid within the total volume may be removed by pushing the liquid with the working gas $W_G$ through the port 250.

The production chamber 230 may have a liquid volume that includes the starting liquid SL and any condensed liquid CL that has returned to the production chamber 230. The production chamber 230 may also have a gas volume that includes the vapor V. The gas volume in the production chamber 230 may also include the working gas $W_G$. The fluid channel 258 also has a liquid volume that includes the condensed liquid CL and a gas volume that includes the vapor V. The gas volume in the fluid channel 258 may also include the working gas $W_G$. The condensing chamber 256 has a liquid volume that includes the condensed liquid CL and a gas volume that includes the vapor V and the working gas $W_G$.

In some embodiments, the liquid volumes within and the pressures experienced by the production chamber 230, the fluid channel 258, and the condensing chamber 256 change throughout radioisotope production. For example, when a portion of the starting liquid SL is transformed into the vapor V, the liquid volume is reduced and the pressure is increased in the production chamber 230. The vapor V flows through the fluid channel 258 into the condensing chamber 256 where the vapor V is then transformed into the condensed liquid CL as described above. Vapor V continues to advance into the condensing chamber 256 as long as the pressure in the production chamber 230 is greater than the pressure in the condensing chamber 256. Thus, the liquid volume in the condensing chamber 256 is inversely related to the liquid volume in the production chamber 230. As the starting liquid SL decreases, the condensed liquid CL increases and vice versa. When the pressure in the production chamber 230 becomes less than the pressure in the condensing chamber 256, the condensed liquid CL is drawn back into the production chamber 230 and mixed with the starting liquid SL.

In some embodiments, the particle beam may be applied intermittently accordingly to a protocol to facilitate the cooling of the starting liquid SL. For example, when the particle beam is not applied to the starting liquid SL, the thermal energy in the production chamber 230 is transferred away from the production chamber 230 through the target body 205. The decrease in thermal energy causes the pressure in the production chamber 230 to reduce. Accordingly, the pressure in the production chamber 230 may become less than the pressure in the condensing chamber 256 when the particle beam is not applied to the starting liquid. Under such conditions, the condensed liquid CL may be sucked or drawn back into the production chamber 230. As shown in FIG. 5, the liquid volume of the starting liquid SL may move back and forth as indicated by the solid and dashed lines.

The production chamber and condensing chambers 230, 256 may have respective volumes. In some embodiments, the volume of the production chamber 230 may be greater than the volume of the condensing chamber 256. However, in alternative embodiments, the volume of the production chamber 230 may be less than or approximately equal to the volume of the condensing chamber 256. The condensing chamber 256 may be sized and shaped relative to the fluid channel 258 so that the vapor is permitted to expand when entering the condensing chamber 256 to facilitate condensation of the vapor V into the condensed liquid CL.

Figure 6:
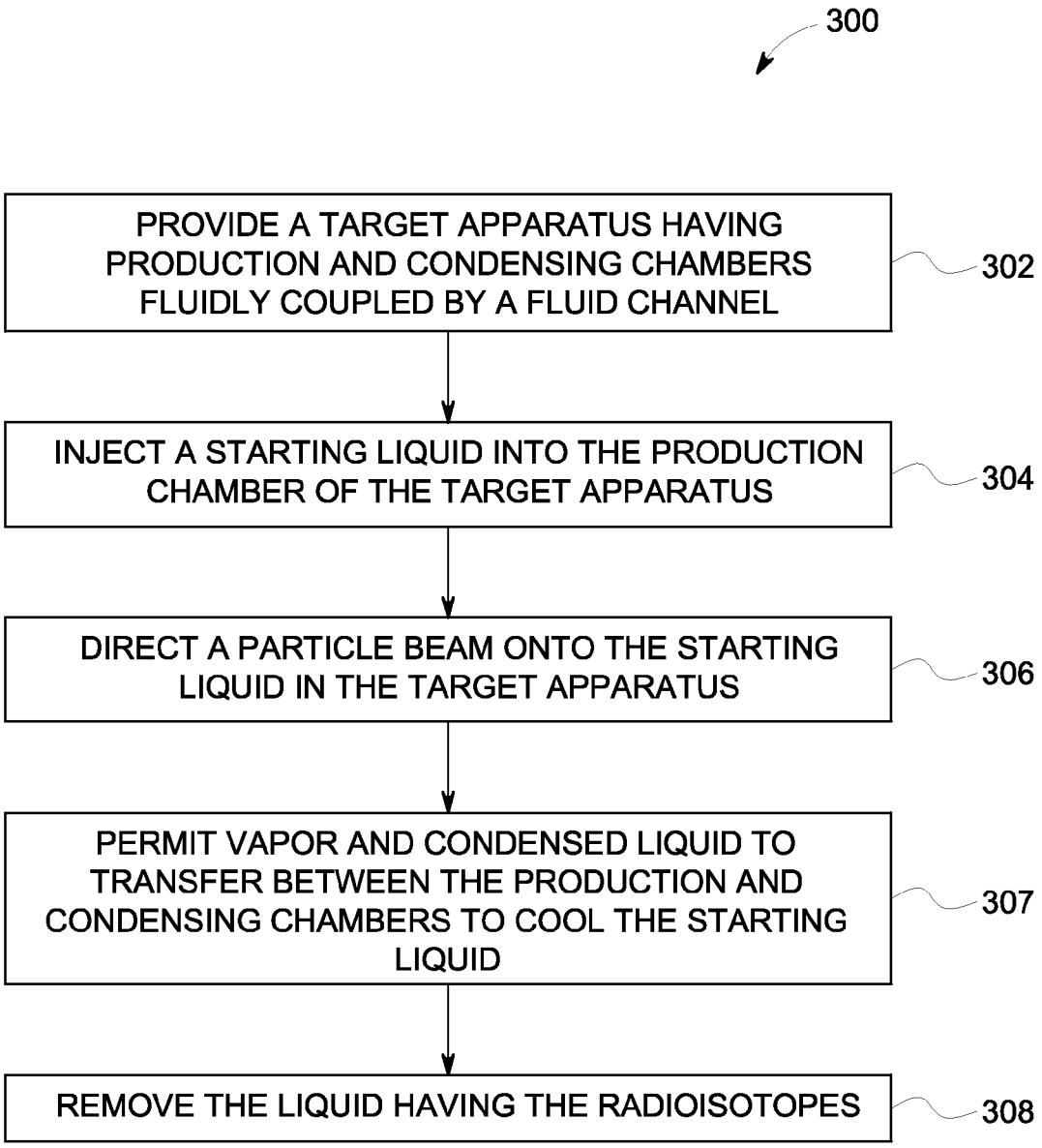
FIG. 6 is a block diagram illustrating a method of operating an isotope production system in accordance with one embodiment.

FIG. 6 is a block diagram illustrating a method 300 of operating a radioisotope production system. The method may include controlling thermal energy in a target apparatus during operation of an isotope production system. The method 300 includes providing at 302 an isotope production system, such as the system 100, or, more specifically, providing a target apparatus. The target apparatus may have production and condensing chambers and a fluid channel, such as those described above with respect to the target apparatus 200. The method also includes injecting at 304 a starting fluid and a working gas into a production chamber of the target apparatus. The starting fluid may be, for example, enriched water, and the working gas may include helium.

The method also includes directing or applying at 306 a particle beam onto the starting liquid at a strike point and permitting at 307 vapor and condensed liquid to transfer between the production and condensing chambers to cool the starting liquid. In some embodiments, the particle beam is applied to the starting liquid in an intermittent or oscillating manner. When the particle beam is applied, a portion of the starting liquid is transformed into vapor (i.e., the starting liquid is vaporized). In a similar manner as described above, the vapor flows through the fluid channel into the condensing chamber. The condensing chamber is configured to transform the vapor into a condensed liquid that returns back to the production chamber thereby cooling the starting liquid. The condensing chamber has a liquid volume of the condensed liquid, and the production chamber has a liquid volume of the starting liquid. As described above, the liquid volumes of the production and condensing chambers are inversely related and fluctuate as the condensed liquid returns to the production chamber through the fluid channel and the vapor enters the condensing chamber through the fluid channel. The method 300 also includes removing at 308 the liquid having the radioisotopes from the target apparatus.

Embodiments described herein are not intended to be limited to generating radioisotopes for medical uses, but may also generate other isotopes and use other target materials. Also the various embodiments may be implemented in connection with different kinds of cyclotrons having different orientations (e.g., vertically or horizontally oriented), as well as different accelerators, such as linear accelerators or laser induced accelerators instead of spiral accelerators. Furthermore, embodiments described herein include methods of manufacturing the isotope production systems, target apparatus, and cyclotrons as described above.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. While the dimensions and types of materials described herein are intended to define the parameters of the various embodiments, the various embodiments are by no means limiting and are exemplary embodiments. Many other embodiments will be apparent to those of skill in the art upon reviewing the above description. The scope of the various embodiments should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This written description uses examples to disclose the various embodiments, including the best mode, and also to enable any person skilled in the art to practice the various embodiments, including making and using any devices or systems and performing any incorporated methods. The patentable scope of the various embodiments is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal languages of the claims.

What is claimed is:

1. A target apparatus for a radioisotope production system, the target apparatus comprising:

a window configured to receive a particle beam;

a production chamber configured to contain a starting liquid, the production chamber configured to receive a particle beam through the window that is incident upon the starting liquid thereby generating radioisotopes and transforming a portion of the starting liquid into vapor;

a condensing chamber that is separate from the production chamber; and a fluid channel fluidly coupling the production and condensing chambers and configured to allow the vapor to flow from the production chamber to the condensing chamber, the condensing chamber being configured to transform the vapor into a condensed liquid.

2. A target apparatus for a radioisotope production system, the target apparatus comprising:

a window configured to receive a particle beam;

a production chamber configured to contain a starting liquid, the production chamber configured to receive a particle beam through the window that is incident upon the starting liquid thereby generating radioisotopes and transforming a portion of the starting liquid into vapor;

a condensing chamber that is separate from the production chamber; and a fluid channel fluidly coupling the production and condensing chambers and configured to allow the vapor to flow from the production chamber to the condensing chamber, the condensing chamber being configured to transform the vapor into a condensed liquid, wherein the condensing chamber and the fluid channel are sized and shaped relative to each other so that the vapor entering the condensing chamber expands.

3. The target apparatus in accordance with claim 1, wherein the condensing chamber and the fluid channel have respective interior surfaces and the target apparatus further comprises a fluid circuit, the fluid circuit including at least two passages on opposite sides of the condensing chamber, the at least two passages being located closer to the condensing chamber than to the fluid channel, the at least two passages transferring thermal energy away from the condensing chamber such that the interior surface of the condensing chamber has a surface temperature that is less than a surface temperature of the interior surface of the fluid channel when the particle beam is incident upon the starting liquid.

4. A target apparatus for a radioisotope production system, the target apparatus comprising:

a window configured to receive a particle beam;

a production chamber configured to contain a starting liquid, the production chamber configured to receive a particle beam through the window that is incident upon the starting liquid thereby generating radioisotopes and transforming a portion of the starting liquid into vapor;

a condensing chamber that is separate from the production chamber; and a fluid channel fluidly coupling the production and condensing chambers and configured to allow the vapor to flow from the production chamber to the condensing chamber, the condensing chamber being configured to transform the vapor into a condensed liquid, wherein the production chamber, the condensing chamber, and the fluid channel are positioned relative to each other such that gravity pulls the condensed liquid toward the production chamber when the target apparatus has a predetermined orientation relative to the gravity.

5. The target apparatus in accordance with claim 1, wherein the production and condensing chambers are at least partially defined by a target body having a body material extending between the production and condensing chambers, the body material including insulative material that reduces transfer of thermal energy from the production chamber to the condensing chamber through the target body.

6. The target apparatus in accordance with claim 1, further comprising a gas line that directly couples to the condensing chamber, wherein the condensing chamber has first and second ports that are in fluid communication with the fluid channel and the gas line, respectively, the first and second ports having a separation distance therebetween.

7. An isotope production system having the target apparatus of claim 1, the system further comprising:

a particle accelerator configured to produce the particle beam and direct the particle beam through the window of the target apparatus.

8. The target apparatus of claim 1, wherein the vapor flows through a production cross-section of the production chamber, a channel cross-section of the fluid channel, and a condensing cross-section of the condensing chamber during generation of the radioisotopes, each of the production, channel, and condensing cross-sections being taken perpendicular to a flow direction of the vapor and having a respective area, wherein the areas of the production and condensing cross-sections are greater than the channel cross-section.

9. The target apparatus in accordance with claim 2, wherein the production chamber, the condensing chamber, and the fluid channel have respective volumes, the volume of the production chamber being greater than the volume of the fluid channel and the volume of the condensing chamber being greater than the volume of the fluid channel.

10. The target apparatus in accordance with claim 9, wherein the fluid channel extends a distance between the production and condensing chambers, the distance being less than 50 millimeters.

11. The target apparatus in accordance with claim 1, wherein the production chamber, the condensing chamber, and the fluid channel are sized and shaped relative to each other such that respective pressures within the production chamber and the condensing chamber fluctuate as the particle beam transforms the starting liquid into vapor and the vapor transforms to the condensed liquid.

12. The target apparatus in accordance with claim 6, further comprising a liquid line that directly couples to the production chamber, the production chamber being positioned between the fluid channel and the liquid line, the gas line and the liquid line being in flow communication through the production chamber, the fluid channel, and the condensing chamber.

13. The target apparatus in accordance with claim 4, wherein the fluid channel and the condensing chamber are fluidly coupled through a first channel port and the fluid channel and the production chamber are fluidly coupled through a second channel port, the first channel port being located along a bottom of the condensing chamber and the second channel port being located along a top of the production chamber, wherein the production chamber, the condensing chamber, and the fluid channel are positioned relative to each other such that the gravity facilitates pulling the condensed liquid through the first and second channel ports during generation of the radioisotopes when the fluid channel and the condensing chamber have the predetermined orientation relative to the gravity.

14. The target apparatus in accordance with claim 4, wherein the production chamber, the condensing chamber, and the fluid channel are sized and shaped relative to each other such that respective pressures within the production chamber and the condensing chamber fluctuate as the particle beam is applied to the starting liquid and wherein the pressure fluctuation and the gravity facilitate moving the condensed liquid into the production chamber.

15. The target apparatus in accordance with claim 4, wherein the production chamber, the condensing chamber, and the fluid channel have respective volumes, the volume of the production chamber being greater than the volume of the fluid channel and the volume of the condensing chamber being greater than the volume of the fluid channel.

16. The target apparatus of claim 1, wherein the fluid channel is configured to allow the condensed liquid to flow from the condensing chamber to the production chamber such that the vapor and the condensed liquid are allowed to flow through the same fluid channel.

17. The target apparatus of claim 16, wherein the fluid channel is a single fluid channel, the production chamber and the condensing chamber being fluidly coupled only through the single fluid channel during generation of the radioisotopes.

18. The target apparatus of claim 16, wherein the target apparatus includes a target housing formed from a plurality of discrete housing sections including a leading housing section and a target body, the target body including a cavity having the window that opens to a front side of the target body, the leading housing section being coupled to the front side of the target body such that the cavity forms the production chamber, the target body being a single continuous structure that entirely defines the fluid channel and at least a portion of the condensing chamber within the target body.

19. The target apparatus of claim 18, wherein the discrete housing sections include a trailing housing section, the target body being stacked between the leading and trailing housing sections, the target apparatus further comprising a plurality of fasteners, each of the fasteners extending through each of the leading housing section, the target body, and the trailing housing section to secure the leading housing section, the target body, and the trailing housing section to one another, wherein the condensing chamber opens to an exterior of the target body, the target apparatus further comprising a cover plate that is secured to the discrete housing sections and encloses the condensing chamber such that the condensing chamber is entirely defined by the target body and the cover plate.

* * * * *